US009068293B2

(12) United States Patent
Duggirala et al.

(10) Patent No.: US 9,068,293 B2
(45) Date of Patent: Jun. 30, 2015

(54) METHOD FOR IMPROVING BRIGHTNESS IN BLEACHED PULP

(71) Applicant: Nalco Company, Naperville, IL (US)

(72) Inventors: Prasad Y. Duggirala, Naperville, IL (US); Sergey M. Shevchenko, Aurora, IL (US)

(73) Assignee: NALCO COMPANY, Naperville, IL (US)

( * ) Notice: Subject to any disclaimer, the term of this patent is extended or adjusted under 35 U.S.C. 154(b) by 4 days.

(21) Appl. No.: 13/851,884

(22) Filed: Mar. 27, 2013

(65) Prior Publication Data

US 2013/0206350 A1 Aug. 15, 2013

Related U.S. Application Data

(63) Continuation-in-part of application No. 13/459,321, filed on Apr. 30, 2012, now Pat. No. 8,617,356, which is a continuation-in-part of application No. 11/387,499, filed on Mar. 23, 2006, now Pat. No. 8,246,780, and a continuation of application No. 13/074,092, filed on Mar. 29, 2011, now Pat. No. 8,262,858, which is a continuation of application No. 11/490,738, filed on Jul. 21, 2006, now Pat. No. 7,914,646.

(60) Provisional application No. 60/721,847, filed on Sep. 29, 2005, provisional application No. 60/718,475, filed on Sep. 19, 2005.

(51) Int. Cl.

| | |
|---|---|
| ***D21C 9/16*** | (2006.01) |
| ***D21H 21/32*** | (2006.01) |
| ***D21C 9/10*** | (2006.01) |
| ***D21H 21/30*** | (2006.01) |
| ***D21H 17/09*** | (2006.01) |

(52) U.S. Cl.

CPC ..... *D21H 21/32* (2013.01); *D21C 9/1084* (2013.01); *D21H 21/30* (2013.01); *D21H 17/09* (2013.01); *D21C 9/1042* (2013.01)

(58) Field of Classification Search

CPC ..... D21H 21/30; D21H 21/32; D21C 9/16; D21C 9/163; D21C 9/166

USPC ..... 162/78

See application file for complete search history.

(56) References Cited

U.S. PATENT DOCUMENTS

| | | | | |
|---|---|---|---|---|
| 5,458,737 | A * | 10/1995 | Diaddario, Jr. | 162/72 |
| 2011/0174455 | A1 * | 7/2011 | Duggirala et al. | 162/181.1 |

* cited by examiner

*Primary Examiner* — Anthony Calandra

(74) *Attorney, Agent, or Firm* — Benjamin E. Carlsen

(57) ABSTRACT

The invention is directed towards methods and compositions for processes based on the combination of organic peroxyacids and ammonium salts that preserve and enhance the response to optical brighteners (fluorescent whitening dyes), brightness and improve color of pulp or paper when applied during different stages of the papermaking process are identified. The composition and method improve response to optical brighteners (fluorescent whitening dyes), maintain and/or enhance brightness and enhance the performance of paper products. Used in combination with optical brighteners the described agents produce a synergistic effect not previously identified in the paper process.

9 Claims, No Drawings

METHOD FOR IMPROVING BRIGHTNESS IN BLEACHED PULP

CROSS-REFERENCE TO RELATED APPLICATIONS

This application is a continuation in part claiming priority from U.S. patent application Ser. No. 13/459,321 filed on Apr. 30, 2012, now U.S. Pat. No. 8,617,356, which itself was a continuation in art of U.S. patent application Ser. No. 11/387,499 filed on Feb. 23, 2006 and which has issued as U.S. Pat. No. 8,246,780 and which also claims the benefit of provisional patent application No. 60/721,847, filed Sep. 29, 2005 and 60/718,475, filed Sep. 19, 2005.

STATEMENT REGARDING FEDERALLY SPONSORED RESEARCH OR DEVELOPMENT

Not Applicable.

BACKGROUND OF THE INVENTION

This invention relates to improved compositions and processes for enhancing brightness and optical properties of a paper product in presence of optical brightening agents (OBA). The effect of the said compositions comes from a combination of brightening (post-bleaching) of the pulp and synergistic activation of optical brighteners.

Pulps produced by either mechanical or chemical pulping methods possess a color that can range from dark brown to creamish depending on the wood type and defibering process used. The pulp is bleached to produce white paper products for a multiplicity of applications. Bleaching is the removal or alteration of those light-absorbing substances found in unbleached pulp. In the bleaching of mechanical pulp, the object is to decolorize the pulp without solubilizing the lignin. Either reducing (e.g. sodium hydrosulfite) or oxidizing (e.g., hydrogen peroxide) bleaching agents are usually used. The bleaching of chemical pulps is an extension of the delignification that started in the digestion stage. The bleaching is often a multistage process, which stages may include chlorine dioxide bleaching, oxygen-alkaline delignification, and peroxide bleaching. Discoloration mostly ascribed to thermal aging, results in yellowing and brightness loss in various stages of papermaking processes employing bleached pulp and in the resultant paper products. The industry invests significantly in chemicals such as bleaching agents and optical brighteners that improve optical properties of the finished paper or paper products.

Peracetic acid (PAA) and its salts, optionally in a combination with hydrogen peroxide, were proposed as chemicals for pulp bleaching and delignification (see U.S. Pat. Nos. 6,258,207 and 5,785,812, US Published Patent Applications 2012/0120067532 and 2004/0000035537, International Patent Applications WO 0052258, WO 9932710, and WO 19990701, Jap. Pat. 06002283, and scientific articles: *Environmental friendly pulping and bleaching of rapeseed stalk fibers*, by Tofanica, B. M. et al., Environmental Engineering and Management Journal, Vol. 11 Issue 3, pp. 681-686, (2012), *Effect of last stage bleaching with peracetic acid on brightness development and properties of eucalyptus pulp*, by Barros, D. P. et al, BioResources, Vol. 5 Issue 2, pp. 0881-0898 (2010), Ramos, E.; *Bleaching of soda pulp of fibers of Musa textilis nee (abaca) with peracetic acid*, by Jimenez, L. et al, Bioresource Technology, Vol. 99 Issue 5, pp. 1474-1480, (2008), *Bleaching of olive tree residues pulp with peracetic acid and comparative study with hydrogen peroxide*, by Lopez, F., Industrial & Engineering Chemistry Research Vol. 41 Issue 15, pp. 3518-3525 (2002), *The effect of peracetic acid treatment of bleached kraft pulp in fine paper production*, by Jakara, J., Preprint—PAPTAC Annual Meeting, 87th, Montreal, QC, Canada, Book B B1-B6, Jan. 30-Feb. 1, 2001 (2001), *Application of peracetic acid in chemical pulp bleaching*, Tripathi, S., Ippta Journal, Vol. 19 Issue 1, pp. 77-82, (2007), and *Delignification and bleaching with peracids. Part 1. Comparison with hydrogen peroxide*, by Delagoutte, T., Paperi ja Puu, Vol. 81 Issue 7, pp. 506-510, (1999).

These references show that sometimes PAA may enhance the efficiency of fluorescent brightening agents. Also when applied under paper mill conditions, PAA may enhance the brightness of pigments and as a side effect efficiently prevent microbial growth in paper machines. In addition PAA may inhibit brightness reversion when PAA is applied to bleached kraft pulp in the bleached pulp storage chests of integrated pulp and paper mills (10-15% consistency), or in the stock preparation chests of paper machines (2-4% consistency). The findings in these references however were not conclusive. In some cases it was found that PAA application as the last pulp bleaching stage had no significant effect on pulp reversion and L*a*b* coordinates. Pulp bleaching applications, generally, require rather high concentrations of the reagent and long process time, e.g., 55C, 4.5% PAA and a bleaching time of at least 150 min. Use of PAA at a dose of 0.5-1.0 kg/TP at ambient temperature and normal plant pulp increased the final pulp brightness by 1.0-1.5 points. Post-bleaching with PAA can be carried out after the bleach plant steps in a pulp flow pipe, a storage tower or in the paper machine at a paper mill.

European Patent Application 1389646 (2004) proposed treatment of a pulp suspension (2-4% consistency) with a composition of peroxyacetic acid and hydrogen peroxide that made the pulp more receptive to the activities of OBA and therefore providing greater paper quality improvement relative to the relative volume of OBA added. It utilized a common commercial PAA that is a blend of approximately 15% PAA peroxyacetic acid and approximately 14% hydrogen peroxide.

A major limitation in all of these applications however is that they are not designed for introduction during a size press operation. Introduction during a size press operation allows for increased efficiencies it terms of both utilization of active components and time of the reaction (almost instantaneous). As a result there is ongoing need and clear utility in a novel improved method and/or composition and/or apparatus for improving brightness in pulp. The art described in this section is not intended to constitute an admission that any patent, publication or other information referred to herein is "Prior Art" with respect to this invention, unless specifically designated as such. In addition, this section should not be construed to mean that a search has been made or that no other pertinent information as defined in 37 CFR §1.56(a) exists.

BRIEF SUMMARY OF THE INVENTION

At least one embodiment of the invention is directed towards a method of preparing a bleached pulp material containing an optical brightener having enhanced brightness. The method comprises: providing bleached pulp material containing an optical brightener; making a paper sheet, and contacting the paper sheet with an effective amount of an organic peroxy acid in a mixture with ammonium salt at pH 4-9. The method may further comprise contacting the bleached pulp material with one or more chelants and/or contacting the bleached pulp material with one or more optical brighteners.

The method may comprise contacting the bleached pulp material with the secondary oxidizing agent selected from the group consisting of hydrogen peroxide, inorganic peroxides, hydroperoxides, superoxides and peroxide-superoxides, inorganic peroxy acids and salts thereof, and water-soluble organic peroxides including dioxiranes, and all of the above in combinations. The bleached pulp material may be selected from the group consisting of virgin pulp, recycled pulp, kraft pulp, sulfite pulp, mechanical pulp, any combination of such pulps, recycled paper, paper tissue, and any paper or paper products made from such pulps or combinations thereof. The optical brighteners may be selected from disulfonated, tetrasulfonated or hexasulfonated stilbene derivatives, and any combination thereof. The chelant may be selected from the group consisting of inorganic polyphosphates, organic phosphonates, phosphates, carboxylic acids, salts of any of the previous members, and any combination thereof and/or may be selected from the group consisting of sodium polyphosphate, sodium tripolyphosphate, diethylene-triamine-pentamethylene phosphonic acid (DTMPA) and salts thereof, diethylenetriaminepentaacetic acid (DTPA) and salts thereof and ethylenediaminetetraacetic acid (EDTA) and salts thereof. The bleached pulp material may be contacted with one or more optical brighteners and one or more chelants and/or the oxidizing agents and optical brighteners may be mixed with a surface sizing solution and applied to the bleached pulp material in a size press.

The oxidizing agents and/or optical brighteners may be mixed with the pulp and applied to the bleached pulp material as a wet paper sheet. The oxidizing agents may be applied on the bleached pulp material before and/or after the optical brightener. The the oxidizing agents, optical brighteners and optionally other components may be mixed in a single product or in a surface sizing solution that is applied to the bleached pulp material in a size press and/or in a surface sizing solution that is applied to the bleached pulp material as a wet paper sheet. The reducing agents and/or optical brighteners and optionally other components may be mixed with the pulp and applied to the bleached pulp material in a thin stock. The dosage of the organic peroxy acid may be insufficient to bleach the paper but is sufficient to increases the brightness of the paper more than the OBA would in the absence of the organic peroxy acid.

At least one embodiment of the invention is directed towards a method of reduction of the doses of optical brighteners applied either at the wet end or both at the wet end and in the size press consisting of reducing the amount of a brightener at the wet end and increasing the amount of a brightener in the size press. The technique is based on the higher response of the optical brightener to the size press treatment of the pulp

DETAILED DESCRIPTION OF THE INVENTION

The following definitions are provided to determine how terms used in this application, and in particular how the claims, are to be construed. The organization of the definitions is for convenience only and is not intended to limit any of the definitions to any particular category.

"Brightness" means the whiteness of pulp or paper, on a scale from 0% (absolute black) to 100% (relative to a MgO standard, which has an absolute brightness of about 96%) by the reflectance of blue light (457 nm) from the paper, it may be measured according to the protocols of ASTM Standard Test Method E313. The CIE measure of Whiteness is a measurement of the light reflected by the paper across the visible (daylight) spectrum. The CIE have set a standard of D65 illumination which is a standard representation of outdoor daylight under which the amount of light reflected is measured.

"Papermaking Process" means a method of making paper products from pulp comprising grinding wood chips and/or other sources of cellulosic fibers and adding water to form an aqueous cellulosic papermaking furnish, draining the furnish to form a sheet, pressing the sheet to remove additional water, and drying the sheet. The steps of forming the papermaking furnish, draining, pressing, and drying may be carried out in any conventional manner generally known to those skilled in the art. The papermaking process includes pulp making.

"Shade" means the color of the paper measured on the CIE LAB model (more formally known as CIE L*, a*, b*). L* is a measure of perceived lightness. The scale of L* is 0-100. a* is a measure of the hue on the red/green axis. A positive value of a* means red and a negative value means green. b* is equivalent with measure of hue on the yellow/blue axis. A positive b* means a yellow hue and a negative value means a blue hue. L*, a*, b* are measured with an instrument that emits D65 light, i.e. a light that is related to daylight with the same amount UV light as in a winter day. 10° is the viewing angle.

The following defined chemicals may be used alone or in a combination with one or more of each other in one or more of the OBA treating methods of this invention.

"Ammonium salt" means ammonium or substituted ammonium salt of an inorganic or organic anionic counterion. Representative ammonium cations include ammonium proper and aklylsubstituted ammonium salt such as methylammonium, dimethylammonium, tetramethylammonium and long-chain substituted ammonium cations (cationic surfactants, quats). Representative anionic counterions include sulfate, chloride, oxalate, and the like. Ammonium hydroxide is also included.

"Carboxylic acids" means organic compounds containing one or more carboxylic group(s), —C(O)OH, preferably aminocarboxylic acids containing a single C—N bond adjacent (vicinal) to the C—CO2H bond, such as EDTA ((HO2CCH2)2NCH2CH2N(CH2CO2H)2), DTPA ((HO2CCH2)2NCH2CH2N(CH2CO2H)CH2CH2N(CH2CO2H)2), and the like and alkaline and alkaline earth metal salts thereof.

"Hydrogen Peroxide" means $H_2O_2$.

"Inorganic peroxides" means monobasic (hydroperoxides) and dibasic (peroxides) metal derivatives of hydrogen peroxide, $H_2SO_2$, including alkali and alkaline earth metal derivatives such as sodium hydroperoxide (NaOOH), magnesium peroxide ($MgO_2$), and the like.

"Inorganic peroxy acids and salts thereof" means inorganic acids containing a —O—O— group, including peroxy monoacids containing the group —OOH and peroxy diacids containing the group —OO—, and their metal salts, such as peroxymonosulfuric acid (Caro's acid, $(HO)_2SO_2OOH$), peroxydisulfuric acid ($HOSO_2OOSO_2OH$), peroxymonophosphoric acid $H_3PO_5$, sodium peroxymonocarbonate $Na_2CO_4$ and peroxydicarbonate $Na_2C_2O_6$, and the like.

"Optical brighteners" are fluorescent dyes or pigments that absorb ultraviolet radiation and reemit it at a higher frequency in the visible spectrum (blue), thereby affecting a white, bright appearance to the paper sheet when added to the stock furnish. Representative optical brighteners include, but are not limited to azoles, biphenyls, coumarins; furans; ionic brighteners, including anionic, cationic, and anionic (neutral) compounds, such as the Eccobrite® and Eccowhite® compounds available from Eastern Color & Chemical Co. (Providence, R.I.); naphthalimides; pyrazenes; substituted (e.g., sulfonated) stilbenes, such as the Leucophor® range of optical brighteners available from the Clariant Corporation (Muttenz, Switzerland), and Tinopal® from Ciba Specialty Chemicals (Basel, Switzerland); salts of such compounds including but not limited to alkali metal salts, alkaline earth metal salts, transition metal salts, organic salts and ammonium salts of such brightening agents; and combinations of one or more of the foregoing agents.

"Organic peroxides" means any organic chemicals containing a —O—O— group, including peroxy acids such as peroxybenzoic acid $C_6H_5C(O)OOH$ and salts thereof, dioxiranes such as dimethyldioxyrane $(CH_3)_2CO_2$ and the like.

"Organic peroxy acid" means compounds of formula $RC(O)O_2H$ and metal salts thereof where R is selected from alkyl, aryl and arylalkyl.

"Organic phosphonates" means organic derivatives of phosphonic acid, $HP(O)(OH)_2$, containing a single C—P bond, such as HEDP (CH3C(OH)(P(O)(OH)2), 1-hydroxy-1,3-propanediylbis-phosphonic acid ((HO)2P(O)CH(OH)CH2CH2P(O)(OH)2)); preferably containing a single C—N bond adjacent (vicinal) to the C—P bond, such as DTMPA ((HO)2P(O)CH2N[CH2CH2N(CH2P(O)(OH)2)2]2), AMP (N(CH2P(O)(OH)2)3), PAPEMP ((HO)2P(O)CH2)2NCH(CH3)CH2(OCH2CH(CH3))2N(CH2)6N(CH2P(O)(OH)2)2), HMDTMP ((HO)2P(O)CH2)2N(CH2)6N(CH2P(O)(OH)2)2), HEBMP (N(CH2P(O)(OH)2)2CH2CH2OH), and the like.

"Organic phosphates" means organic derivatives of phosphorous acid, P(O)(OH)3, containing a single C—P bond, including triethanolamine tri(phosphate ester) (N(CH2CH2OP(O)(OH)2)3), and the like.

"Peroxygen producing chemical" means a composition of matter that contains two or more oxygen atoms in the form of an oxygen-oxygen bond and that induce a higher oxidation state in another composition of matter, peroxygen producing chemical includes but is not limited to: hydrogen peroxide, percarbonate salts, persulfate salts, perborate salts, permanganate salts, carbamide peroxide, and alkyl peroxides such as tert-butyl hydroperoxide and potassium monopersulfate, and any compound of the formula $R—(COOOH)_n$ in which R can be hydrogen, alkyl, alkenyl, alkyne, acylic, alicyclic group, aryl, heteroaryl, or heterocyclic group, and n is 1, 2, or 3, and named by prefixing the parent acid with peroxy, as well as those sulfonated carboxylic acid compositions described in as disclosed in US Published Patent Applications 2010/0021557, 2010/0048730 and 2012/0052134, peroxygen producing chemicals are a form of PAA.

"Peroxide-superoxides" means mixed alkali metal derivatives of a formula $2MO_2.M_2O_2$ such as $K_2O_3$, and the like.

"Peroxyhydrates", means inorganic salts containing hydrogen peroxide of crystallization, such as sodium metasilicate peroxyhydrate $Na_2SiO_3.H_2O_2.H_2O$, and sodium borate peroxyhydrate $NaBO_2*H_2O_2.3H_2O$, and the like.

"Superoxides" means metal derivatives containing the group of $O_2^-$, including alkali and alkaline earth metal derivatives such as sodium superoxide ($NaO_2$), calcium superoxide ($CaO_2$), and the like.

This application also incorporates by reference all of the terminology, understandings, and definitions provided in the reference: *Measurement and Control of the Optical Properties of Paper by Technidyne Corporation, New Albany, Ind.*. In the event that a term used in this application can only be understood if it is construed by another dictionary or reference, if the term is defined by the *Kirk-Othmer Encyclopedia of Chemical Technology*, 5th Edition, (2005), (Published by Wiley, John & Sons, Inc.) this definition shall control how the term is to be defined.

At least one embodiment of the invention is a method of preparing a bleached pulp material containing OBA that has enhanced brightness and whiteness (color scheme). The method comprises: (1) providing a bleached pulp material; (2) making a paper sheet and (3) contacting the paper sheet at the wet sheet formation or surface sizing stage with an effective amount of an organic peroxyacid (e.g., PAA) in a combination with an ammonium salt at the formulation pH from about 4 to about 9 (6 to 7 preferred that provides for a non-corrosive product with a broad application range). Optionally the PAA and OBA are combined with one or more other oxidizing agents of the same or different chemical nature and one or more chelants.

While PAA has previously been used in pulps they have been thought of as a bleaching agent or as a biocide. Never before however has PAA in combination with ammonium sulfate been recognized as a chemical which activates and enhances OBA. Applicants have discovered a novel mechanism of PAA's effect on OBA and a never reported synergism of PAA with ammonium sulfate (AS) and understanding this mechanism has allowed applicants to invent a number of novel uses of PAA with OBA including a novel way of applying PAA or a PAA-AS composition on paper, that have been taught away by the prior art.

PAA has never been thought possible being used with OBA in the size press because introducing PAA there would drop the pH significantly enough to negatively affect the main process and cause corrosion. Moreover, a negative oxidative effect of PAA on OBA was suspected. Thus, the scientific paper *The effect of peracetic acid in fine paper production* goes so far as to say that in order to prevent an unwanted reaction between OBA or dyes in a papermaking process and PAA, the concentration of PAA must be kept very low.

Without being limited by a particular theory or design of the invention or of the scope afforded in construing the claims, it is believed that the PAA oxidizes the carbonyl groups in hemicelluloses which would otherwise interfere with the fluorescence effect of the OBA. This results in an enhanced fluorescence effect in pulp by the non-interfered with OBA. The applicants found that this process is most efficient when PAA is applied in a size press. Because such an application ensures all the uptaken chemicals reacting with the pulp, low doses are efficient. This makes a critical economical difference to alternative applications described in the prior art. Moreover, the applicants found that PAA alone while efficiently increasing brightness, does not improve whiteness as much. This deficiency was fully compensated by combining PAA with ammonium sulfate that has never been proposed before.

As a result, prior art such as US Published Patent Application 2004/0000035537 which does not contemplate effecting carbonyl groups with PAA is limited to treatment of cellulose suspensions in the stock preparation chests of paper machines (2-4% consistency). Similarly International Patent Applications WO 0052258, WO 9932710, and WO 19990701 describe an "after-bleaching" process for chemical cellulose pulp specifying the dose of PAA in the range of approximately 0.1-5 kg per metric ton of dry pulp, indicated as 100% PAA. These references, while acknowledging a beneficial effect of PAA on brightness, ascribe it entirely to the pulp bleaching (post-bleaching) effect. They provide no teaching whatsoever regarding the effect pre-treating pulp with PAA would have on the effectiveness of OBA added to the pulp. It is very characteristic that European Patent Application 1389646 (2004) contemplates application of PAA exclusively in cellulose suspensions emphasizing that the process of pulp modification under the claimed conditions takes not less than 30 minutes. The current Invention claims application in a sizing solution that means direct application on a formed paper sheet. In this case the reaction occurs in a dryer section (no residence time whatsoever), it is almost instantaneous and it protects the sheet from thermal brightness loss in a dryer. It also teaches that application of PAA in a sizing solution, due to low residence time, can be combined with pH adjustment to near-neutral that protects pulp from undesirable consequences of low pH and at the same time does not affect the activity of PAA.

In at least one embodiment the pre-treatment with PAA is in pulp treated with OBAs, and activation with PAA can be achieved even at doses that provide little or no bleaching effect as well as on fully bleached pulp effectively devoid of lignin that normally is associated with coloration. In at least one embodiment the treatment is more efficient on paper during surface sizing.

In at least one embodiment the PAA is applied into systems in which reductive activation of OBA is not effective. As described in U.S. patent application Ser. No. 13/459,321, a different mechanism for activating OBA is the use of reducing compositions. This reductive treatment however is significantly less effective when the pH is higher and/or in presence of significant quantities of calcium ions.

In at least one embodiment a pulping operation utilizes a switching strategy to activate the OBA. In a switching strategy the pulper determines which of oxidizing (such as with PAA) pre-treatment or reducing treatment would be optimal for a given pulping operation and applies that one to the pulp. The determination of which treatment is optimal is based on such issues as relative availability or costs of reagents, kind of paper product to be produced, kind of pulp, process conditions, or equipment to be used, and potential interactions between either the PAA or the reducing agent with another additive or piece of equipment that will be present in the papermaking process. A switching strategy would be ideal in situations where whiteness must be significantly increased. While PAA by itself improves brightness, when used with OBA it does not impart much whiteness of paper when applied in conjunction with OBAs. Thus a reducing activation pre-treatment may be useful for making highly white grades of paper and PAA activation pre-treatment may be useful for making less white grades of the exact same paper.

In at least one embodiment the PAA is applied to the cellulose in the sizing solution. Prior art PAA compositions have not been applied in sizing solutions because they impart and rely upon pH conditions that destroy the effectiveness of other compositions present in the sizing agents. In at least one embodiment added alongside the PAA is a pH adjusting agent that prevents the added PAA from altering the pH of the sizing solution (or prevents the change in pH from exceeding a magnitude which would degrade the sizing solution's effectiveness). Although it has an indigenous acidic pH, PAA effectively enhances OBA at any pH. As a result, the invention provides significantly better performance than the best benchmark and makes this technology more convenient and cost-saving. In at least one embodiment the PAA is present in a solution having a pH at which the PAA does not function as bleach or as a biocide.

In at least one embodiment the PAA treatment effectively enhances the brightness and color scheme of paper products synergistically with (a) optical brighteners and (b) between PAA and ammonium salts, together resulting in enhancement of the effect of the OBAs and PAA and improving color scheme.

In at least one embodiment the method of application of proposed chemistries that makes a paper product having enhanced brightness comprises the steps of: (1) providing a bleached pulp; (2) forming an aqueous stock suspension comprising bleached pulp; (3) draining the stock suspension to form a sheet; and (4) drying the sheet to form the paper product, which process may involve an intermediate stage of surface sizing. An effective amount of one or more oxidizing agents described above is added to the wet (before dryers) or dry (between the dryers in the size press) sheet. Optical brighteners may be applied together with, after or before the oxidizing agents. Chelants may be applied in combination with the reducing agents.

In at least one embodiment function additives are also added to the papermaking process. Functional additives are typically those additives that are used to improve or impart certain specifically desired properties to the final paper product and include but are not limited to brightening agents, dyes, fillers, sizing agents, starches, and adhesives.

In at least one embodiment control additives are also added to the papermaking process. Control additives, on the other hand, are additives incorporated during the process of manufacturing the paper so as to improve the overall process without significantly affecting the physical properties of the paper. Control additives include biocides, retention aids, defoamers, pH control agents, pitch control agents, and drainage aids. Paper and paper products made using the process of the present invention may contain one or more functional additives and/or control additives.

In at least one embodiment pigments and/or dyes are added to the papermaking process. Pigments and dyes impart color to paper. Dyes include organic compounds having conjugated double bond systems; azo compounds; metallic azo compounds; anthraquinones; triaryl compounds, such as triarylmethane; quinoline and related compounds; acidic dyes (anionic organic dyes containing sulfonate groups, used with organic rations such as alum); basic dyes (cationic organic dyes containing amine functional groups); and direct dyes (acid-type dyes having high molecular weights and a specific, direct affinity for cellulose); as well as combinations of the above-listed suitable dye compounds. Pigments are finely divided mineral that can be either white or colored. The pigments that are most commonly used in the papermaking industry are clay, calcium carbonate and titanium dioxide.

In at least one embodiment fillers are added to the papermaking process. Fillers, are added to paper to increase opacity and brightness. Fillers include but are not limited to calcium carbonate (calcite); precipitated calcium carbonate (PCC); calcium sulfate (including the various hydrated forms); calcium aluminate; zinc oxides; magnesium silicates, such as talc; titanium dioxide ($TiO_2$), such as anatase or rutile; clay, or kaolin, consisting of hydrated $SiO_2$ and $Al_2O_3$; synthetic clay; mica; vermiculite; inorganic aggregates; perlite; sand; gravel; sandstone; glass beads; aerogels; xerogels; seagel; fly ash; alumina; microspheres; hollow glass spheres; porous ceramic spheres; cork; seeds; lightweight polymers; xonotlite (a crystalline calcium silicate gel); pumice; exfoliated rock; waste concrete products; partially hydrated or unhydrated hydraulic cement particles; and diatomaceous earth, as well as combinations of such compounds.

In at least one embodiment sizing agents are added to the papermaking process. Sizing agents are added to the paper during the manufacturing process to aid in the development of a resistance to penetration of liquids through the paper. Sizing agents can be internal sizing agents or external (surface) sizing agents, and can be used for hard-sizing, slack-sizing, or both methods of sizing. More specifically, sizing agents include rosin; rosin precipitated with alum ($Al_2(SO_4)_3$); abietic acid and abietic acid homologues such as neoabietic acid and levopimaric acid; stearic acid and stearic acid derivatives; ammonium zirconium carbonate; silicone and silicone-containing compounds, such as RE-29 available from GE-OSI and SM-8715, available from Dow Corning Corporation (Midland, Mich.); fluorochemicals of the general structure CF3(CF2)nR, wherein R is anionic, cationic or another functional group, such as Gortex; alkylketene dimer (AKD), such as Aquapel 364, Aquapel (I 752, Heron) 70, Hercon 79, Precise 787, Precise 2000, and Precise 3000, all of which are commercially available from Hercules, Incorporated (Willmington, Del.); and alkyl succinic anhydride (ASA); emulsions of ASA or AKD with cationic starch; ASA incorporating alum; starch; hydroxymethyl starch; carboxymethylcellulose (CMC); polyvinyl alcohol; methyl cellulose; alginates; waxes; wax emulsions; and combinations of such sizing agents.

In at least one embodiment starch is added to the papermaking process. Starch has many uses in papermaking. For example, it functions as a retention agent, dry-strength agent and surface sizing agent. Starches include but are not limited to amylose; amylopectin; starches containing various amounts of amylose and amylopectin, such as 25% amylose and 75% amylopectin (corn starch) and 20% amylose and 80% amylopectin (potato starch); enzymatically treated starches; hydrolyzed starches; heated starches, also known in the art as "pasted starches"; cationic starches, such as those resulting from the reaction of a starch with a tertiary amine to form a quaternary ammonium salt; anionic starches; ampholytic starches (containing both cationic and anionic functionalities); cellulose and cellulose derived compounds; and combinations of these compounds.

The PAA may be added using conventional papermaking equipment. Although papermaking equipment varies in operation and mechanical design, the processes by which paper is made on different equipment contain common stages. Papermaking typically includes a pulping stage, bleaching stage, stock preparation stage, a wet end stage and a dry end stage.

In the pulping stage, individual cellulose fibers are liberated from a source of cellulose either by mechanical or chemical action, or both. Representative sources of cellulose include, but are not limited to, wood and similar "woody" plants, soy, rice, cotton, straw, flax, abaca, hemp, bagasse, lignin-containing plants, and the like, as well as original and recycled paper, paper tissue and paperboard. Such pulps include, but are not limited to, groundwood (GWD), bleached groundwood, thermomechanical pulps (TMP), bleached thermomechanical pulps, chemi-thermomechanical pulps (CTMP), bleached chemi-thermomechanical pulps, deinked pulps, kraft pulps, bleached kraft pulps, sulfite pulps, and bleached sulfite pulps.

Recycled pulps may or may not be bleached in the recycling stage, but they are presumed to be originally bleached. Any of the pulps described above which have not previously been subjected to bleaching may be bleached as described herein to provide a bleached pulp material.

In an embodiment, the bleached pulp material is selected from the group consisting of virgin pulp, recycled pulp, kraft, sulfite pulp, mechanical pulp, any combination of such pulps, recycled paper, paper tissue, and any paper made from such listed pulps or combinations thereof.

The pulp is suspended in water in the stock preparation stage. Additives such as brightening agents, dyes, pigments, fillers, antimicrobial agents, defoamers, pH control agents and drainage aids also may be added to the stock at this stage. As the term is used in this disclosure, "stock preparation" includes such operations as dilution, screening and cleaning of the stock suspension that may occur prior to forming of the web.

The wet end stage of the papermaking process comprises depositing the stock suspension or pulp slurry on the wire or felt of the papermaking machine to form a continuous web of fibers, draining of the web and consolidation of the web ("pressing") to form a sheet. Any papermaking machine known in the art is suitable for use with the process of the present invention. Such machines may include cylinder machines, fourdrinier machines, twin wire forming machines, tissue machines, and the like, and modifications thereof.

In the dry end stage of the papermaking process, the web is dried and may be subjected to additional processing like size pressing, calendering, spray coating with surface modifiers, printing, cutting, corrugating and the like. In addition to a size press and calender waterbox, the dried paper can be coated by spray coating using a sprayboom.

In at least one embodiment oxidative agents combined with ammonium salts are used to activate OBA. Oxidative agents combined with ammonium salts (and optionally with chelants) in a formulation at a near-neutral pH as described below effectively enhance the brightness and color scheme of a paper product containing an optical brightener. In at least one embodiment, the chelant is a compound selected from the group consisting of organic phosphonate, phosphate, carboxylic acids, salts of any of the previous members, and any combination thereof. The oxidative agents also improve the color scheme. This permits reduction of the amount of OBA's and brighteners such as blue dyes necessary to achieve comparable brightness and color. Replacing some of the OBA and dyes with oxidative agents allows pulp and paper manufacturers to reduce production costs and reduce the overall amount of OBA and dyes present, while maintaining an acceptable level of brightness in the paper product and achieving the target color. In some cases it may be possible to eliminate dyes entirely and maintain color. Accordingly, in another embodiment, one or more optical brighteners ("OBA's") are added to the bleached pulp or paper product. In an embodiment, the optical brighteners are selected from the group of disulfonated, tetrasulfonated and hexasulfonated Tinopal® OBAs.

In at least one embodiment the dosage of oxidative agents, chelants and/or optical brighteners is the amount necessary to achieve the desired brightness and resistance to yellowing of the bleached pulp or paper product prepared from the bleached pulp and can be readily determined by one of skill in the art based on the characteristics of chelant or optical brightener, the pulp or paper being treated and the method of application.

Typically, about 0.005 to about 2, preferably about 0.05 to about 0.25 weight percent, based on oven-dried pulp of oxidative agent is added to the bleached pulp or paper product. In a typical application, about 0.001 to about 1, preferably about 0.01 to about 0.1 weight percent of peracetic acid and about 0.002 to about 0.1 weight percent of ammonium sulfate based on oven-dried pulp is added to the bleached pulp or paper product. Optical brighteners are typically added in amounts of about 0.005 to about 2, preferably 0.05 to about 1 weight percent of optical brightener based on oven-dried pulp.

The chemicals can be added to bleached pulp or paper at any point in the papermaking or tissue making process. Representative addition points include, but are not limited to (a) to the pulp slurry in the latency chest; (b) to the pulp after the bleaching stage in a storage, blending or transfer chest; (c) to pulp after bleaching, washing and dewatering followed by cylinder or flash drying; (d) before or after the cleaners; (e) before or after the fan pump to the paper machine headbox; (f) to the paper machine white water; (g) to the silo or save all; (h) in the press section using, for example, a size press, coater or spray bar; (i) in the drying section using, for example, a size press, coater or spray bar; (j) on the calender using a wafer box; and/or (k) on paper in an off-machine coater or size press; and/or (l) in the curl control unit.

Application can be by any means conventionally used in papermaking processes, including by "split-feeding" whereby a portion of the chemical formulation is applied at one point in the papermaking process, for example on pulp or a wet sheet (before the dryers) and the remaining portion is added at a subsequent point, for example in the size press.

In at least one embodiment, peracetic acid, ammonium sulfate and optical brightener are mixed with the surface sizing solution and applied in the size press.

At these various locations, the formulations can also be added with a carrier or additive typically used in paper making, such as retention aids, sizing aids and solutions, starches, precipitated calcium carbonate, ground calcium carbonate, or other clays or fillers, and brightening additives.

Contemplated formulations may have a pH of about 4-9, more preferably about 6-7 that provides for a non-corrosive formulation that does not affect the pH of the sizing solution and is compatible with other technologies practiced in the papermaking stage.

The formulations may be used in addition to other additives conventionally used in papermaking to improve one or more properties of the finished paper product, assist in the process of manufacturing the paper itself, or both. These additives are generally characterized as either functional additives or control additives.

Examples

The foregoing may be better understood by reference to the following examples, which is presented for purposes of illustration and is not intended to limit the scope of the invention. All percentages in these examples are given on a weight percent dry pulp basis. In the Examples, the following terms shall have the indicated meaning. BR for ISO brightness R457 (TAPPI 525); WI for E313 Whiteness; PAA for peracetic, AS for ammonium sulfate as solids, OBA for optical brightener, EW for ExtraWhite NW1 brightness enhancer of Nalco-Ecolab company (benchmark). PAA is introduced as commercial products (PAA1=12% PAA+20% hydrogen peroxide; PAA2=15% PAA+11% hydrogen peroxide) and a formulation based on this invention (PAA-AS1=12.7% PAA+9.4% hydrogen peroxide+16.5% ammonium sulfate). PAA-AS1 is formulated with PAA2 that is a commercial product.

Treatment

Handsheets were made of bleached kraft softwood pulp and then used in the experiments, in which the oxidative agents were applied either on a wet sheet (before or after the press) before drum drying or after drum drying (temperature during drum drying: 100° C.). The third option was split-feed application. The surface sizing application was followed by one more round on a drum dryer.

In the Examples, the chemistries were applied on softwood kraft, drum-dried handsheets, in a surface sizing solution with starch (5% based on o.d. paper), with Tinopal-ABP used as a sample OBA when needed.

The load of the tested Agent or Composition solution was determined based on the dry weight of the pulp sample. The Agent or Composition solutions were applied using a rod, as uniformly as possible, as solutions in water. The test sheets were dried using a laboratory drum drier under uniform conditions (one round) and then, after measuring the brightness, subjected to the accelerated aging tests as described below.

The handsheets were made using a Noble&Wood handsheet mold (8 in.sq., 60 g/m2). Brightness was measured using a Technidyne instrument.

Test Equipment:

Laboratory drum drier.

"Technidyne Color Touch 2 (Model ISO)" or another instrument for brightness measurements, Micropipette.

Surface size application kit (pad and size 3-application rod).

Constant humidity room (23° C., 50% humidity).

Water bath/thermostat accommodating a floating plastic box with paper samples. 100-mL application cuvette for the soaking method.

Dry Surface Application Procedure (Surface Sizing, Soaking Method):

1. Prepare 8×8-inch hand sheet according to the standard procedure. The target dry weight is 2.5 g. Pass wet hand sheets through one cycle on the drum dryer.
2. Cut ⅛th strip of the sheet (0.31 g).
3. In a 50 ml test tube, prepare solutions of pre-cooked starch (if needed) and reducing agent compound solutions based on the pre-determined pickup rate and target dose.
4. Dip the paper strip into the solution for 10 seconds, let it drip for 35 seconds and then pass it through the press.
5. Drum-dry the test sheet and equilibrate at room temperature.
6. Measure brightness and yellowness.

Optical brighteners can be combined with oxidative performance enhancers in a surface sizing solution. Generally, optical brighteners can react with oxidants. However, we found that the conditions of surface sizing process are mild enough to prevent this from happening.

TABLE 1

| Samples (with OBA) | BR | WI | L* | a* | b* |
|---|---|---|---|---|---|
| Control | 91.24 | 99.50 | 94.843 | −0.143 | −2.703 |
| 0.25% PAA1 | 92.76 | 99.41 | 95.780 | −0.260 | −2.207 |
| 0.5% PAA1 | 92.87 | 99.64 | 95.810 | −0.237 | −2.247 |
| 1% PAA1 | 93.17 | 100.44 | 95.850 | −0.237 | −2.403 |
| 0.5% PAA1 + 0.1% (NH3)2SO4 | 92.95 | 100.15 | 95.763 | −0.237 | −2.383 |
| 0.5% PAA1 + 0.1% Urea | 93.01 | 100.14 | 95.793 | −0.273 | −2.363 |
| 0.5% H2O2 | 92.47 | 98.48 | 95.767 | −0.320 | −2.007 |
| 1% H2O2 | 92.74 | 98.55 | 95.920 | −0.320 | −1.947 |
| 1% H2O2 + 0.2% (NH3)2SO4 | 92.74 | 99.98 | 95.657 | −0.287 | −2.400 |
| 1% H2O2 + 0.2% Urea | 92.85 | 98.75 | 95.957 | −0.267 | −1.977 |

This table shows a much stronger activation effect of PAA vs hydrogen peroxide (compare doses) <we should add ure to Claims!>. It also shows that the PAA is active at low doses and increasing the dose does not result in a significant improvement at a high brightness range.

TABLE 2

| Samples (with OBA) | BR | WI | L* | a* | b* |
|---|---|---|---|---|---|
| Control | 95.09 | 110.93 | 94.987 | 0.407 | −5.163 |
| 0.5% EW | 95.88 | 113.23 | 95.023 | 0.497 | −5.657 |
| 0.25% PAA1 | 96.43 | 112.32 | 95.473 | 0.367 | −5.237 |
| 0.5% PAA1 | 96.66 | 112.26 | 95.613 | 0.350 | −5.153 |
| 1% PAA1 | 97.16 | 112.77 | 95.790 | 0.327 | −5.183 |
| 0.1% (NH3)2SO4 | 95.56 | 113.18 | 94.843 | 0.447 | −5.733 |
| 0.25% PAA1 + 0.1% (NH3)2SO4 | 96.49 | 114.03 | 95.203 | 0.423 | −5.753 |

TABLE 2-continued

| Samples (with OBA) | BR | WI | L* | a* | b* |
|---|---|---|---|---|---|
| 0.5% PAA1 + 0.1% (NH3)2SO4 | 96.67 | 113.89 | 95.320 | 0.380 | −5.667 |

This table shows improvement in whiteness when PAA is combined with AS.

TABLE 3

| Samples (with OBA) | BR | WI | L* | a* | b* |
|---|---|---|---|---|---|
| Control | 94.74 | 111.36 | 94.713 | 0.383 | −5.393 |
| 0.25% PAA1 (as product) | 96.05 | 111.54 | 95.403 | 0.350 | −5.097 |
| 0.05% (NH3)2SO4 | 95.05 | 111.40 | 94.870 | 0.403 | −5.323 |
| 0.125% PAA1 + 0.05% (NH3)2SO4 | 95.85 | 112.13 | 95.187 | 0.377 | −5.333 |
| 0.25% PAA1 + 0.05% (NH3)2SO4 | 96.00 | 112.18 | 95.260 | 0.360 | −5.307 |
| 0.25% PAA1 pH = 5 as product | 96.17 | 111.47 | 95.487 | 0.337 | −5.043 |
| 0.25% PAA1 pH = 6 as product | 95.95 | 110.91 | 95.470 | 0.350 | −4.927 |
| 0.25% PAA1 pH = 7 as product | 96.09 | 111.24 | 95.490 | 0.357 | −4.990 |
| 0.25% PAA1 pH = 8 as product | 95.96 | 110.69 | 95.517 | 0.333 | −4.857 |
| 0.25% PAA1 + 0.05% (NH3)2SO4 pH = 6 | 96.17 | 112.52 | 95.307 | 0.397 | −5.367 |

This table shows that the effect of PAA is stable in a pH range typical of sizing solutions.

TABLE 4

| Samples (with OBA) | BR | WI | L* | a* | b* |
|---|---|---|---|---|---|
| Control w/o OBA | 90.86 | 98.94 | 94.713 | −0.120 | −2.643 |
| 0.125% PAA1 w/o OBA | 91.43 | 98.80 | 95.080 | −0.173 | −2.430 |
| Control + 0.25% OBA | 94.86 | 110.97 | 94.830 | 0.407 | −5.250 |
| 0.125% PAA1 + 0.25% OBA | 95.76 | 111.37 | 95.267 | 0.380 | −5.127 |
| 0.125% PAA1 + 0.05% (NH3)2SO4 | 95.92 | 111.61 | 95.317 | 0.410 | −5.153 |
| 0.125% PAA1 pH = 6 | 95.54 | 110.35 | 95.343 | 0.357 | −4.863 |
| 0.125% PAA1 + 0.05% (NH3)2SO4 pH = 6 | 95.74 | 111.77 | 95.197 | 0.410 | −5.250 |
| 0.125% PAA1 pH = 8 | 95.51 | 110.53 | 95.287 | 0.360 | −4.930 |
| 0.125% PAA1 + 0.05% (NH3)2SO4 pH = 8 | 95.65 | 111.26 | 95.227 | 0.387 | −5.123 |
| Control, sizing sol. pH = 8 | 94.97 | 109.80 | 95.107 | 0.373 | −4.857 |
| 0.25% EW1 | 95.54 | 111.72 | 95.090 | 0.440 | −5.293 |
| 0.25% EW1 sol. pH = 8 | 95.42 | 111.42 | 95.083 | 0.450 | −5.223 |
| 0.125% PAA1 + 0.05% (NH3)2SO4 sol. pH = 8 | 95.64 | 111.20 | 95.243 | 0.387 | −5.100 |

This table shows a much stronger activation effect of PAA vs. a reductive formulation for OBA activation.

TABLE 5

| Samples (with OBA) | BR | WI | L* | a* | b* |
|---|---|---|---|---|---|
| Control w/o OBA | 90.74 | 99.91 | 94.467 | −0.130 | −2.977 |
| Control + 0.25% OBA | 94.74 | 111.36 | 94.713 | 0.383 | −5.393 |
| 0.5% EW | 95.55 | 113.88 | 94.723 | 0.477 | −5.943 |
| 0.25% PAA1 (as product) w/o OBA | 91.63 | 98.85 | 95.190 | −0.203 | −2.387 |
| 0.25% PAA1 (as product) | 96.05 | 111.54 | 95.403 | 0.350 | −5.097 |
| 0.05% (NH3)2SO4 | 95.05 | 111.40 | 94.870 | 0.403 | −5.323 |
| 0.125% PAA1 + 0.05% (NH3)2SO4 | 95.85 | 112.13 | 95.187 | 0.377 | −5.333 |
| 0.25% PAA1 + 0.05% (NH3)2SO4 | 96.00 | 112.18 | 95.260 | 0.360 | −5.307 |

TABLE 5-continued

| Samples (with OBA) | BR | WI | L* | a* | b* |
|---|---|---|---|---|---|
| 0.25% PAA1 pH = 5 as product | 96.17 | 111.47 | 95.487 | 0.337 | −5.043 |
| 0.25% PAA1 pH = 6 as product | 95.95 | 110.91 | 95.470 | 0.350 | −4.927 |
| 0.25% PAA1 pH = 7 as product | 96.09 | 111.24 | 95.490 | 0.357 | −4.990 |
| 0.25% PAA1 pH = 8 as product | 95.96 | 110.69 | 95.517 | 0.333 | −4.857 |
| 0.25% PAA1 + 0.05% (NH3)2SO4 pH = 6 | 96.17 | 112.52 | 95.307 | 0.397 | −5.367 |

This table shows that the effect of PAA at low doses in a pH range typical of sizing solutions.

TABLE 6

| Samples (with OBA) | BR | WI | L* | a* | b* |
|---|---|---|---|---|---|
| control | 94.53 | 108.49 | 95.1 | 0.42 | −4.567 |
| control + 0.25% EW | 95.20 | 110.59 | 95.113 | 0.46 | −5.03 |
| 0.125% PAA2 | 95.57 | 110.14 | 95.386 | 0.453 | −4.8 |
| 0.125% PAA-AS1 | 95.55 | 110.65 | 95.29 | 0.457 | −4.957 |
| 0.125% PAA-AS1, pH sizing solution 6 with NaOH | 95.46 | 110.39 | 95.29 | 0.427 | −4.9 |
| 0.125% PAA-AS1, pH sizing solution 6 with Na2CO3 | 95.33 | 109.97 | 95.296 | 0.443 | −4.8 |
| 0.125% PAA-AS1, pH sizing solution 7 with NaOH | 95.61 | 110.55 | 95.337 | 0.47 | −4.91 |
| 0.125% PAA-AS1, pH sizing solution 7 with Na2CO3 | 95.46 | 110.12 | 95.343 | 0.443 | −4.81 |
| 0.125% PAA-AS1, pH sizing solution 8 with NaOH | 95.39 | 110.12 | 95.297 | 0.433 | −4.837 |
| 0.125% PAA-AS1, pH sizing solution 8 with Na2CO3 | 95.32 | 109.63 | 95.35 | 0.45 | −4.7 |

This table shows performance of the recommended formulation in a pH range typical of sizing solutions, with pH adjustment using (a) sodium hydroxide (preferred) and (b) sodium carbonate; the effect of alternative ammonium salts is shown for comparison.

TABLE 7

| Samples (with OBA) | BR | WI | L* | a* | b* |
|---|---|---|---|---|---|
| Control w/o OBA | 90.86 | 98.94 | 94.713 | −0.120 | −2.643 |
| 0.125% PAA1 w/o OBA | 91.43 | 98.80 | 95.080 | −0.173 | −2.430 |
| Control + 0.25% OBA | 94.86 | 110.97 | 94.830 | 0.407 | −5.250 |
| 0.125% PAA1 + 0.25% OBA | 95.76 | 111.37 | 95.267 | 0.380 | −5.127 |
| 0.125% PAA1 + 0.05% (NH3)2SO4 | 95.92 | 111.61 | 95.317 | 0.410 | −5.153 |
| 0.125% PAA1 pH = 6 | 95.54 | 110.35 | 95.343 | 0.357 | −4.863 |
| 0.125% PAA1 + 0.05% (NH3)2SO4 pH = 6 | 95.74 | 111.77 | 95.197 | 0.410 | −5.250 |
| 0.125% PAA1 + pH = 8 | 95.51 | 110.53 | 95.287 | 0.360 | −4.930 |
| 0.125% PAA1 + 0.05% (NH3)2SO4 pH = 8 | 95.65 | 111.26 | 95.227 | 0.387 | −5.123 |
| Control, sizing sol. pH = 8 | 94.97 | 109.80 | 95.107 | 0.373 | −4.857 |
| 0.25% EW1 | 95.54 | 111.72 | 95.090 | 0.440 | −5.293 |
| 0.25% EW1 sol. pH = 8 | 95.42 | 111.42 | 95.083 | 0.450 | −5.223 |
| 0.125% PAA1 + 0.05% (NH3)2SO4 sol. pH = 8 | 95.64 | 111.20 | 95.243 | 0.387 | −5.100 |

This table shows synergism between PAA and AS in a pH range typical of sizing solutions; pH adjusted with sodium hydroxide

TABLE 8

| Samples (with OBA) | BR | WI | L* | a* | b* |
|---|---|---|---|---|---|
| control | 94.41 | 109.41 | 94.873 | 0.423 | −4.88 |
| control + 0.25% EW | 95.1167 | 111.45 | 94.913 | 0.503 | −5.317 |
| 0.25% PAA-AS1, pH = 7 in sizing solution with NaOH | 95.68 | 110.99 | 95.31 | 0.47 | −5.023 |
| 0.125% PAA-AS1, pH = 7 in sizing solution with NaOH | 95.41 | 111.15 | 95.123 | 0.47 | −5.15 |
| 0.0625% PAA-AS1, pH = 7 in sizing solution with NaOH | 95.03 | 110.313 | 95.063 | 0.46 | −4.99 |
| 0.25% PAA-AS1, pH = 6 in sizing solution with NaOH | 95.83 | 111.66 | 95.27 | 0.467 | −5.187 |
| 0.125% PAA-AS1, pH = 6 in sizing solution with NaOH | 95.3 | 110.64 | 95.157 | 0.457 | −5.02 |
| 0.0625% PAA-AS1, pH = 6 in sizing solution with NaOH | 95.003 | 110.29 | 95.05 | 0.447 | −4.993 |
| 0.125% PAA-AS1, pH = 7 in sizing solution with Na2CO3 | 95.433 | 111.21 | 95.13 | 0.467 | −5.157 |
| 0.125% PAA-AS1, pH = 6 in sizing solution with Na2CO3 | 95.387 | 110.83 | 95.173 | 0.45 | −5.05 |
| 0.125% PAA-AS1 + 0.65% CaCl2, pH = 7 with NaOH | 96.073333 | 112.92 | 95.127 | 0.4967 | −5.543 |
| 0.65% CaCl2, pH = 7 | 95.36 | 111.61 | 94.95 | 0.473 | −5.333 |

This table shows performance of the recommended formulation in a pH range typical of sizing solutions, with pH adjustment using (a) sodium hydroxide (preferred) and (b) sodium carbonate.

TABLE 9

(hexasulfonated OBA)

| Samples (with OBA) | BR | WI | L* | a* | b* |
|---|---|---|---|---|---|
| control | 90.44 | 97.95 | 94.65 | −0.083 | −2.457 |
| 0.5% OBA | 96.27 | 113.86 | 95.047 | 0.56 | −5.79 |
| 0.25% OBA | 94.42 | 109.30 | 94.89 | 0.43 | −4.847 |
| 0.5% OBA + 0.68% CA | 96.84 | 115.24 | 95.05 | 0.537 | −6.097 |
| 0.25% OBA + 0.68% CA | 95.33 | 111.63 | 94.95 | 0.497 | −5.337 |
| 0.5% OBA + 0.68% CA + 0.25% EW | 97.44 | 116.93 | 95.07 | 0.58 | −6.463 |
| 0.25% OBA + 0.68% CA + 0.25% EW | 95.64 | 112.45 | 94.98 | 0.503 | −5.507 |
| 0.5% OBA + 0.68% CA + 0.125% PAA-AS1 | 97.59 | 116.66 | 95.22 | 0.57 | −6.323 |
| 0.25% OBA + 0.68% CA + 0.125% PAA-AS1 | 95.71 | 111.91 | 95.13 | 0.487 | −5.313 |
| 0.5% OBA + 0.125% PAA-AS1 | 96.97 | 114.90 | 95.24 | 0.577 | −5.93 |
| 0.25% OBA + 0.125% PAA-AS1 | 95.45 | 111.0567 | 95.16 | 0.44 | −5.113 |
| 0.5% OBA + 0.25% EW | 97.15 | 116.8833 | 94.98 | 0.6167 | −6.487 |
| 0.25% OBA + 0.25% EW | 95.35 | 112.3767 | 94.87 | 0.5 | −5.543 |

This table shows performance in presence of a (standard) hexasulfonated OBA of the recommended formulation in presence of calcium chloride as a 32% solution (CA) and at different doses of the OBA; a 30% replacement is projected.

TABLE 10

(tetrasulfonated OBA)

| Samples (with OBA) | BR | WI | L* | a* | b* |
|---|---|---|---|---|---|
| control | 90.54 | 98.35 | 94.6367 | −0.09 | −2.55 |
| 0.5% OBA | 97.97 | 118.16 | 95.08 | 0.52 | −6.727 |
| 0.25% OBA | 96.27 | 114.317 | 94.967 | 0.59 | −5.923 |
| 0.5% OBA + 0.68% CA | 97.91 | 115.95 | 95.217 | 0.0167 | −6.167 |
| 0.25% OBA + 0.68% CA | 96.84 | 114.78 | 95.063 | 0.3367 | −5.987 |
| 0.5% OBA + 0.68% CA + 0.25% EW | 98.57 | 117.92 | 95.24 | 0.0967 | −6.6 |
| 0.25% OBA + 0.68% CA + 0.25% EW | 97.24 | 116.13 | 95.073 | 0.393 | −6.28 |
| 0.5% OBA + 0.68% CA + 0.125% PAA-AS1 | 98.61 | 117.25 | 95.38 | −0.01 | −6.38 |
| 0.25% OBA + 0.68% CA + 0.125% PAA-AS1 | 97.58 | 116.04 | 95.26 | 0.34 | −6.17 |
| 0.5% OBA + 0.125% PAA-AS1 | 98.577 | 117.953 | 95.407 | 0.373 | −6.527 |
| 0.25% OBA + 0.125% PAA-AS1 | 97.27667 | 115.74 | 95.27 | 0.586667 | −6.1 |
| 0.5% OBA + 0.25% EW | 98.54 | 119.15 | 95.21 | 0.566667 | −6.887 |
| 0.25% OBA + 0.25% EW | 97.24 | 117.20 | 94.993 | 0.66 | −6.56 |

This table shows performance in presence of a tetrasulfonated OBA of the recommended formulation in presence of calcium chloride as a 32% solution (CA) and at different doses of the OBA; a 30% replacement is projected.

The examples demonstrate that optical brighteners can be combined with oxidative performance enhancers in a surface sizing solution. Generally, optical brighteners are expected to react with oxidants. However, the data shows that the conditions of surface sizing process are mild enough to prevent this from happening.

Additional Embodiments

The method for inhibiting corrosion of a solid by contacting the solid with an effective amount of the compound or composition in the manner described above may be applied in a number of other uses.

The methods, compounds and compositions of the present invention are useful for corrosion inhibition of containers, processing facilities, or equipment in the food service or food processing industries. The methods, compounds and compositions have particular value for use on food packaging materials and equipment, and especially for cold or hot aseptic packaging. Examples of process facilities in which the compound of the invention can be employed include a milk line dairy, a continuous brewing system, food processing lines such as pumpable food systems and beverage lines, ware wash machines, low temperature ware wash machines, dishware, bottle washers, bottle chillers, warmers, third sink washers, processing equipment such as tanks, vats, lines, pumps and hoses (e.g., dairy processing equipment for processing milk, cheese, ice cream and other dairy products), and transportation vehicles. The methods, compounds and compositions of the invention can be used to inhibit corrosion in tanks, lines, pumps, and other equipment used for the manufacture and storage of soft drink materials, and also used in the bottling or containers for the beverages.

The methods, compounds and compositions can also be used on or in other industrial equipment and in other industrial process streams such as heaters, cooling towers, boilers, retort waters, rinse waters, aseptic packaging wash waters, and the like. The methods, compounds and compositions can be used to treat surfaces in recreational waters such as in pools, spas, recreational flumes and water slides, fountains, and the like.

According to an embodiment of the invention, it is desirable to use the corrosion inhibitor compositions and the claimed methods of use to inhibit the corrosion of metal surfaces contacted with cleaners in surfaces found in janitorial and/or housekeeping applications, food processing equipment and/or plant applications, and in laundry applications. For example, the corrosion of washers, such as tunnel washers for washing textiles, may be inhibited according to methods of the claimed invention.

In addition, surfaces may be contacted according to the methods of the present invention for use in low temperature dish and/or warewash sanitizing final rinse, toilet bowl cleaners, and laundry bleaches. According to further embodiments of the invention, the methods are used to treat metal surfaces, such as ware, cleaned and/or sanitized with corrosive sources.

While this invention may be embodied in many different forms, there described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments described herein and/or incorporated herein. In addition the invention encompasses any possible combination that also specifically excludes any one or more of the various embodiments described herein and/or incorporated herein.

The above disclosure is intended to be illustrative and not exhaustive. This description will suggest many variations and alternatives to one of ordinary skill in this art. The compositions and methods disclosed herein may comprise, consist of, or consist essentially of the listed components, or steps. As used herein the term "comprising" means "including, but not limited to". As used herein the term "consisting essentially of" refers to a composition or method that includes the disclosed components or steps, and any other components or steps that do not materially affect the novel and basic characteristics of the compositions or methods. For example, compositions that consist essentially of listed ingredients do not contain additional ingredients that would affect the properties of those compositions. Those familiar with the art may recognize other equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure. Weight percent, percent by weight, % by weight, wt %, and the like are synonyms that refer to the concentration of a substance as the weight of that substance divided by the weight of the composition and multiplied by 100. Percentages and ratios are by weight unless otherwise so stated.

As used in this specification and the appended claims, the singular forms "a," "an," and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise. All chemical structures provided in this application contemplate and include every possible stereo isomers, conformational isomers, rotational isomers, and chiral alternative of the specific illustrated structure.

This completes the description of the preferred and alternate embodiments of the invention. Those skilled in the art may recognize other equivalents to the specific embodiment described herein which equivalents are intended to be encompassed by the claims attached hereto.

What is claimed is:

1. A method of preparing a bleached pulp material containing an optical brightener having enhanced brightness comprising:

contacting bleached pulp material with an optical brightener, making a paper sheet out of the bleached pulp material, and contacting the paper sheet with a composition, the composition comprising an effective amount of an organic peroxy acid in a mixture with ammonium salt at pH 4-9 the ammonium salt having an ammonium portion ionically bonded to an anionic counter ion, the ammonium portion being one selected from the list consisting of methylammonium, dimethylammonium, and urea.

2. The method of claim 1 further comprising contacting the bleached pulp material with one or more chelants.

3. The method of claim 1 further comprising contacting the bleached pulp material with one or more other optical brighteners.

4. The method of claim 1, further comprising contacting the bleached pulp material with a secondary oxidizing agent selected from the group consisting of hydrogen peroxide, inorganic peroxides, hydroperoxides, superoxides and peroxide-superoxides, inorganic peroxy acids and salts thereof, and water-soluble organic peroxides including dioxiranes, and any combinations thereof.

5. The method of claim 1, wherein the bleached pulp material is selected from the group consisting of virgin pulp, recycled pulp, kraft pulp, sulfite pulp, mechanical pulp, any combination of such pulps, recycled paper, paper tissue, and any paper or paper products made from such pulps or combinations thereof.

6. The method of claim 1 wherein the optical brighteners are selected from disulfonated, tetrasulfonated or hexasulfonated stilbene derivatives.

7. The method of claim 2, wherein the chelant is selected from the group consisting of inorganic polyphosphates, organic phosphonates, phosphates, carboxylic acids, salts of any of the previous members, and any combination thereof.

8. The method of claim 7, wherein the chelant is selected from the group consisting of sodium polyphosphate, sodium tripolyphosphate, diethylene-triamine-pentamethylene phosphonic acid (DTMPA) and salts thereof, diethylenetriaminepentaacetic acid (DTPA) and salts thereof and ethylenediaminetetraacetic acid (EDTA) and salts thereof.

9. The method of claim 1 wherein the composition excludes cationic starch of the type which forms by the reaction of a starch with a tertiary amine.

* * * * *